United States Patent [19]

Takahashi et al.

[11] Patent Number: 4,520,559

[45] Date of Patent: Jun. 4, 1985

[54] APPARATUS FOR PAIRING TWO ROWS OF SLIDE FASTENER ZIGZAG COUPLING ELEMENTS

[75] Inventors: Kihei Takahashi, Uozu; Yusei Sassa, Namerikawa, both of Japan

[73] Assignee: Yoshida Kogyo K. K., Tokyo, Japan

[21] Appl. No.: 570,252

[22] Filed: Jan. 12, 1984

[30] Foreign Application Priority Data

Jan. 20, 1983 [JP] Japan ..... 58-8561

[51] Int. Cl.[3] ..... A41H 37/06; B21D 53/52

[52] U.S. Cl. ..... 29/766; 29/410

[58] Field of Search ..... 29/766–770, 29/408–410, 33.2

[56] References Cited

U.S. PATENT DOCUMENTS

| | | | |
|---|---|---|---|
| 2,613,433 | 10/1952 | Rojahn | 29/766 |
| 3,168,606 | 2/1965 | Burbank | 29/410 |
| 3,197,537 | 7/1965 | Hansen | 29/410 |
| 3,836,413 | 9/1974 | Frohlich et al. | 29/408 |
| 3,947,946 | 4/1976 | Omori et al. | 29/766 |
| 4,290,194 | 9/1981 | Takahashi | 29/766 |

*Primary Examiner*—Howard N. Goldberg
*Assistant Examiner*—Steven Nichols
*Attorney, Agent, or Firm*—Hill, Van Santen, Steadman & Simpson

[57] ABSTRACT

A coupling-element pairing apparatus includes a substantially Y-shaped guide channel defined in a base and including a joint passage for interengaging disengaged rows of continuous filamentary zigzag coupling elements. The joint passage has a width narrow enough to substantially prevent interengaged rows of coupling elements from moving laterally with respect to one another. A pair of toothed guide wheels disposed one on each side of the joint passage for guidingly advancing the interengaged rows of coupling elements through the guide channel. Each guide wheel has a plurality of peripheral teeth, two adjacent ones of which project into the joint passage for holding therebetween one of the connecting portions of each row of coupling elements at opposite ends thereof without impairing the coupling elements.

5 Claims, 4 Drawing Figures

APPARATUS FOR PAIRING TWO ROWS OF SLIDE FASTENER ZIGZAG COUPLING ELEMENTS

BACKGROUND OF THE INVENTION

1. Field of the Invention

The present invention relates to an apparatus for interengaging or mating a pair of rows of slide fastener coupling elements respectively formed from a pair of continuous plastic filaments into a zigzag shape.

2. Prior Art

To manufacture a pair of elongate slide fastener stringers each having a row of continuous zigzag coupling elements, it has been customary to shape a continuous thermoplastic synthetic resin monofilament into a row of zigzag coupling elements by means of a heated die wheel, then to attach by sewing two such rows of coupling elements to a pair of stringer tapes along their opposed edges, then to pair the rows of coupling elements into a chain of coupling elements, and finally to mount top and bottom end stops and sliders on the coupling element chain. For the purposes of increasing rate of production, there has been a need for a machine that can pair the rows of coupling elements before being sewn to the stringer tapes. Many attempts have been made to devise such a pairing machine, however, the results have been unsatisfactory in that the coupling elements formed from a plastic monofilament would be easily deformed under compressing or tensioning force applied as they are interengaged.

SUMMARY OF THE INVENTION

It is therefore an object of the present invention to provide a coupling-element pairing apparatus which enables a pair of rows of continuous filamentary zigzag coupling elements to be mated nicely and reliably without causing any deformation.

According to the present invention, a pairing apparatus includes a substantially Y-shaped guide channel defined in a base and including a joint passage for interengaging disengaged rows of continuous filamentary zigzag coupling elements. The joint passage has a width narrow enough to substantially prevent interengaged rows of coupling elements from moving laterally with respect to one another. The apparatus further includes a pair of toothed guide wheels disposed one on each side of the joint passage for guidingly advancing the interengaged rows of coupling elements through the guide channel. Each guide wheel has a plurality of peripheral teeth, two adjacent ones of which project into the joint passage for holding therebetween one of the connecting portions of each row of coupling elements at opposite ends thereof. Preferably, the guide channel has a hollow configuration having a depth substantialy equal to the height of the coupling elements, and the teeth on each guide wheel have a thickness substantially equal to the depth of the guide channel, whereby the interengaged rows of coupling elements can be fed smoothly without causing relative movement in both lateral and vertical directions.

Many other advantages and features of the present invention will become manifest to those versed in the art upon making reference to the detailed description and the accopanying sheets of drawings in which a preferred structural embodiment incorporating the principles of the present invention is shown by way of illustrative example.

DETAILED DESCRIPTION

Figure 1:
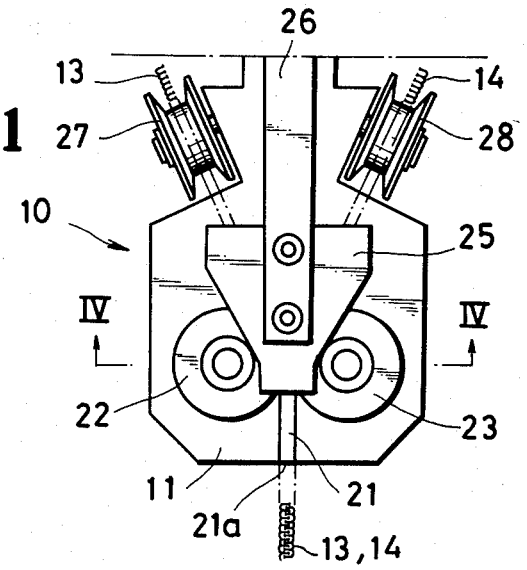
FIG. 1 is a schematic plan view of a pairing apparatus constructed in accordance with the present invention.

The principles of the present invention are particularly useful when embodied in a pairing apparatus such as shown in FIG. 1, generally indicated by the numeral 10.

Figure 3:
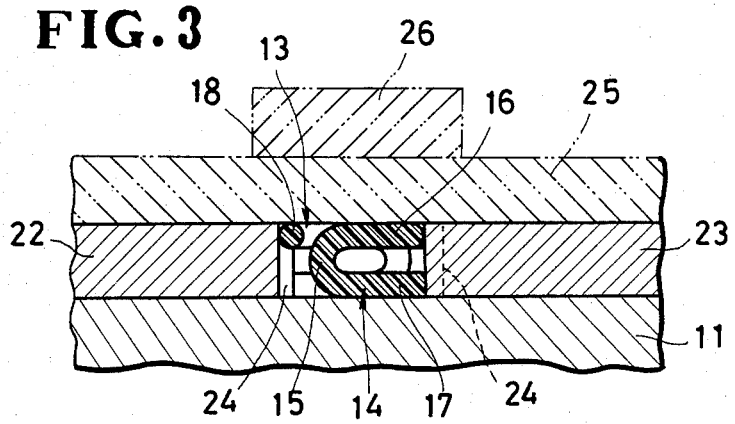
FIG. 3, appearing with FIG. 1, is a cross-sectional view taken along line III—III of FIG. 2.
Figure 2:
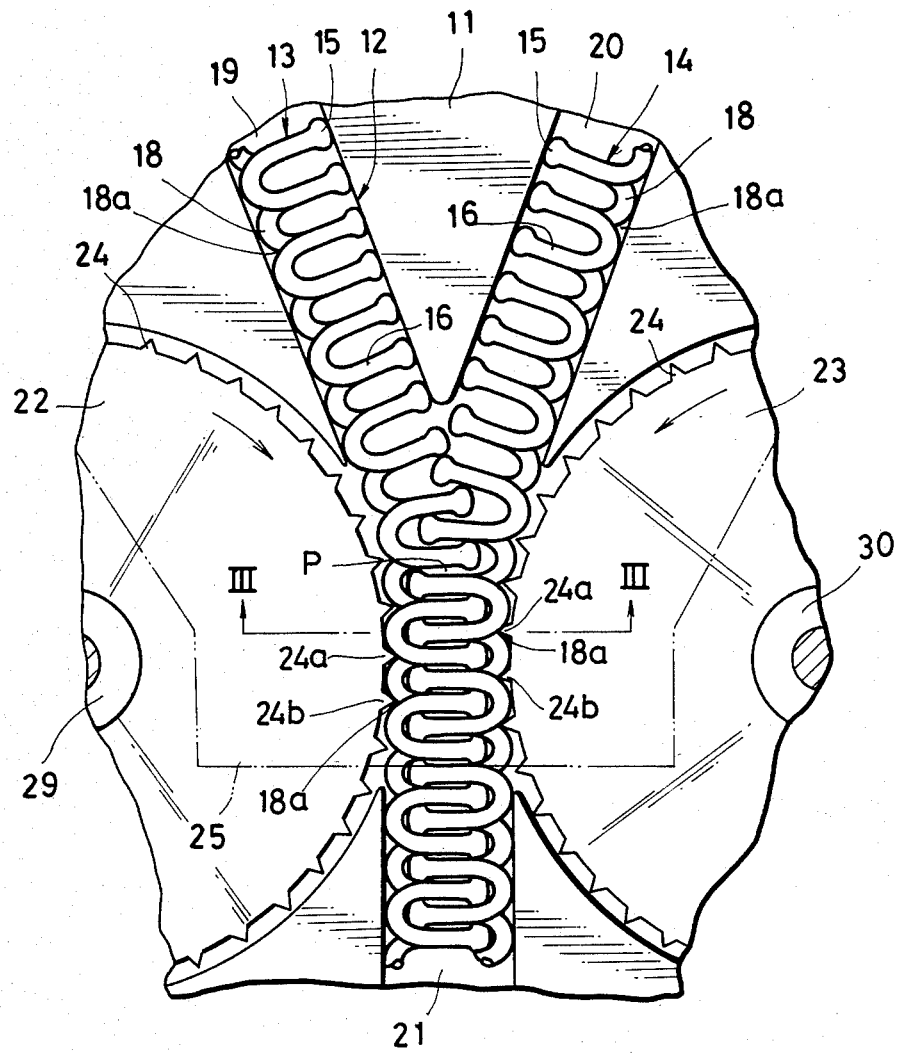
FIG. 2 is an enlarged fragmentary view of FIG. 1 with parts removed for clarity.

The pairing apparatus 10 comprises a flat base 11 having a substantially Y-shaped guide channel 12 (FIG. 2) for the passage therethrough of a pair of rows of slide fastener coupling elements 13, 14, the guide channel 12 being open at the upper side. Each row of coupling elements 13, 14 is formed from a continuous plastic monofilament into meandering or zigzag shape. As shown in FIGS. 2 and 3, each of the zigzag coupling elements 13, 14 has a coupling head 15, a pair of parallel spaced upper and lower legs 16, 17 extending from the coupling head 15 in a common direction, and an arcuate connecting portion 18 extending between one of the legs 16, 17 and a corresponding one leg 16 or 17 of an adjacent coupling element to interconnect the two adjacent coupling elements remotely from their coupling heads 15. Thus, the connecting portions 18 includes two groups, one connecting adjacent uper legs 16 and the other connecting adjacent lower legs 17. There are defined between adjacent arcuate connecting portions 18 a plurality of recesses 18*a* (FIG. 2) opening away from the coupling heads 15.

As shown in FIG. 2, the Y-shaped guide channel 12 includes a pair of angularly spaced branch guide passages 19, 20 for receiving disengaged rows of coupling elements 13, 14, respectively, and a joint passage 21 into which the branch guide passages 19, 20 merge for interengaging the disengaged rows of coupling elements 13, 14 in the joint passage 21. The guide channel 12 has a pair of inlet openings (not shown) for introducing therefrom the disengaged rows of coupling elements 13, 14 into the branch guide passages 19, 20, respectively, and an outlet opening 21*a* (FIG. 1) remote from the inlet openings for discharging interengaged rows of coupling elements 13, 14.

A pair of coplanar guide wheels 22, 23 is rotatably mounted on the base 11, one on each side of the joint passage 21. The guide wheels 22, 23 are spaced a predetermined distance from each other for guiding therebetween the interengaged rows of coupling elements 13, 14. Each guide wheel 22, 23 has a plurality of peripheral projections or teeth 24 spaced at equal intervals and projectable into the joint passage 21 for engagement with the interengaged rows of coupling elements 13, 14 to discharge the latter from the guide channel 12.

As shown in FIG. 1, the pairing apparatus 10 further includes a substantially triangular cover plate 25 supported on one end of a support lever 26 to normally overlie the base 11 and the guide wheels 22, 23. Thus, the guide channel 12 is closed by the cover plate 25 from above and forms a substantially hollow configuration as shown in FIG. 3. The support lever 26 is pivotably connected at the other end to the base 11 so that the cover plate 25 is angularly movable away from the base 11 for enabling easy access to the guide wheels 22, 23. A pair of guide rollers 27, 28 is rotatably mounted on the base 11 respectively upstream of the branch guide passages 19, 20 for guiding the disengaged rows of coupling elements 13, 14 into the respective branch guide passages 19, 20.

As shown in FIGS. 2 and 3, the joint passage 21 of the guide channel 12 has a width narrow enough to urge the coupling heads 15 of one row of coupling elements 13 or 14 toward the connecting portions 18 of the other row of coupling elements 14 or 13 until the interengaged rows of coupling elements 13, 14 are substantially prevented from moving laterally with respect to each other in the joint passage 21. The teeth 24 on the guide wheels 22, 23 are straight and parallel to the axis of the respective guide wheels 22, 23 and have a substantially triangular shape in radial cross section. The teeth 24 have a thickness substantially the same as both the depth of the guide channel 12 and the thickness or height of the coupling elements 13, 14 (FIG. 3). The teeth 24 also have a pitch substantially equal to the pitch of each row of coupling elements 13, 14 so that they can hold the coupling elements 13, 14 at opposite ends of the connecting portions 18. More specifically, the guide wheels 22, 23 are radially spaced from each other such a distance that two adjacent teeth 24*a*, 24*b* on each guide wheel 22, 23 substantially completely project into the joint passage 21 slightly downstream of a position P where the branch guide passages 19, 20 join together, and are received in two adjacent recesses 18*a* (FIG. 2) between three adjacent connecting portions 18.

Figure 4:
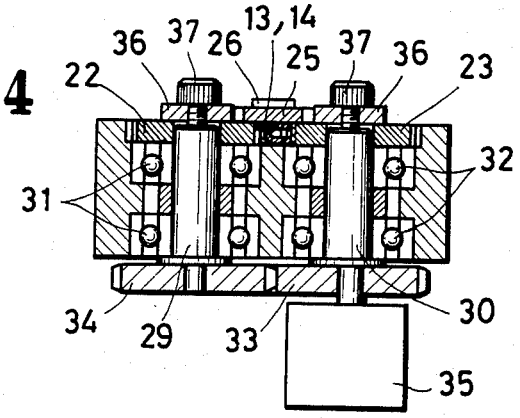
FIG. 4, appearing with FIG. 1, is an enlarged cross-sectional view taken along line IV—IV of FIG. 1.

As shown in FIG. 4, the guide wheels 22, 23 are secured respectively to one end of a pair of shafts 29, 30 rotatably mounted via a pair of sets of ball bearings 31, 32 on the base 11. A drive gear 33 is secured to the other end of the shaft 30 and is held in driving engagement with a driven gear 34 secured to the other end of the shaft 29, both gears 33, 34 being identical with each other. A drive means 35 such as a motor is connected to the shaft 30 to rotate the guide wheels 22, 23 at the same speed but in opposite directions. In order to adjust the positions of the guide wheels 22, 23 accurately with respect to each other and to prevent rotation of the guide wheels 22, 23 with respect to the shafts 29, 30, double nuts 36, 37 are threaded to the one end of the shafts 29, 30.

In operation, the disengaged rows of coupling elements 13, 14 progress through the branch guide passages 19, 20, respectively, and are meshed or interengaged into a chain of coupling elements 13, 14 at the position P in the joint passage 21. The interengaged rows of coupling elements 13, 14 are fed by the teeth 24 which engage the connecting portions 18 as the guide wheels 22, 23 rotate in opposite directions, and then they are discharged out of the outlet opening 21*a*.

With the pairing apparatus 10 thus constructed, the interengaged rows of coupling elements 13, 14 are protected from being damaged or otherwise deformed because they are substantially prevented from moving laterally with respect to each other while being advanced along the joint passage 21 by means of the toothed guide wheels 22, 23 disposed one on each side of the joint passage 21. Since the guide channel 12 is a hollow configuration and the teeth 24 of the guide wheels 22, 23 have a thickness substantially the same as both the depth of the guide channel 12 and the height of the coupling elements 13, 14, forces applied from the teeth 24 onto the connecting portions 18 of the coupling elements 13, 14 are uniformly distributed over the coupling elements 13, 14. This construction ensures that the interengaged rows of coupling elements 13, 14 have a uniform pitch throughout the length thereof.

Although various minor modifications may be suggested by those versed in the art, it should be understood that we wish to embody within the scope of the patent warranted hereon, all such embodiments as reasonably and properly come within the scope of our contribution to the art.

What is claimed is:

1. An apparatus for interengaging a pair of rows of continuous slide-fastener zigzag coupling elements, each element having a coupling head, a pair of spaced legs extending from the coupling head in a common direction, and a connecting portion disposed remote from the coupling head and extending between one of the legs and a corresponding one leg of an adjacent coupling element, said apparatus comprising:

(a) a base defining therein a substantially Y-shaped guide channel including a pair of branch guide passages for receiving disengaged rows of coupling elements, respectively, said branch guide passages being joined together into a joint passage for mating the disengaged rows of coupling elements, said joint passage having a width narrow enough to substantially prevent interengaged rows of coupling elements from moving laterally with respect to each other; and (b) a pair of coplanar guide wheels rotatably mounted on said base one on each side of said joint passage for guiding therebetween the interengaged rows of coupling elements, each said guide wheel having a plurality of peripheral teeth engageable with the interengaged rows of coupling elements for feeding the rows of coupling elements through said guide channel, two adjacent ones of said teeth projecting into said joint passage for holding therebetween one connecting portion at opposite ends thereof.

2. An apparatus according to claim 1, said guide channel being open at one side, and including a cover plate disposed on said base and said guide wheels to close said one side of said guide channel, thereby making said guide channel into a substantially hollow configuration.

3. An apparatus according to claim 2, said guide channel having a depth substantially the same as the height of the coupling elements, said teeth having a thickness substantially the same as the depth of the guide channel.

4. An apparatus according to claim 1, said two adjacent teeth projecting into said joint passage slightly downstream of a position where said branch guide passages merge.

5. An apparatus according to claim 1, said teeth having a pitch substantially equal to the pitch of each row of coupling elements and each being receivable in a recess between adjacent connecting portions.

* * * * *